US011534667B2

(12) United States Patent
Dixon et al.

(10) Patent No.: US 11,534,667 B2
(45) **Date of Patent: *Dec. 27, 2022**

(54) CUSTOMIZED GOLF PUTTERS AND METHODS OF CONSTRUCTING CUSTOMIZED GOLF PUTTERS

(71) Applicants: Emily Dixon, Alpharetta, GA (US); Craig Forney, Johns Creek, GA (US)

(72) Inventors: Emily Dixon, Alpharetta, GA (US); Craig Forney, Johns Creek, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/468,940

(22) Filed: Sep. 8, 2021

(65) Prior Publication Data

US 2021/0402268 A1 Dec. 30, 2021

Related U.S. Application Data

(63) Continuation of application No. 16/875,883, filed on May 15, 2020, now Pat. No. 11,141,636.

(60) Provisional application No. 62/901,555, filed on Sep. 17, 2019.

(51) Int. Cl.

| | |
|---|---|
| ***A63B 53/06*** | (2015.01) |
| ***A63B 53/02*** | (2015.01) |
| ***A63B 53/08*** | (2015.01) |
| ***A63B 53/04*** | (2015.01) |

(52) U.S. Cl.

CPC ..... *A63B 53/065* (2013.01); *A63B 53/02* (2013.01); *A63B 53/08* (2013.01); *A63B 2053/0491* (2013.01); *A63B 2209/08* (2013.01)

(58) Field of Classification Search

CPC ..... A63B 53/02; A63B 53/021; A63B 53/022; A63B 53/023; A63B 53/025; A63B 53/026; A63B 53/027; A63B 53/028; A63B 53/0491; A63B 53/065; A63B 53/007; A63B 53/0487; A63B 2209/08; A63B 2053/0491; A63B 53/08

USPC ..... 473/305–315

See application file for complete search history.

(56) References Cited

U.S. PATENT DOCUMENTS

| | | | | |
|---|---|---|---|---|
| 3,392,977 A * | 7/1968 | De Lacey | ..... | A63B 53/007 473/306 |
| 3,397,888 A * | 8/1968 | Springer | ..... | A63B 53/007 473/248 |
| 5,116,047 A * | 5/1992 | Phelan | ..... | A63B 53/007 473/307 |
| 5,348,295 A * | 9/1994 | Phillips | ..... | A63B 60/00 473/307 |
| 5,437,447 A * | 8/1995 | Rigutto | ..... | A63B 53/065 473/251 |

(Continued)

*Primary Examiner* — Sebastiano Passaniti

(57) ABSTRACT

Customizable golf putters are disclosed. The putters include a putter face; a putter head that is configured to be reversibly connected to the putter face (with the putter head being selected from a plurality of different putter head styles); and a hosel that is configured to be reversibly connected to any of a plurality of hosel receiving channels that are accessible on a top surface of the putter head (the hosel is also selected from a plurality of different hosel styles). The golf putters further include a threaded shaft connector that is configured to reversibly connect the hosel to a putter shaft. In addition, the golf putters include one or more peg fillers, which are configured to be inserted into empty hosel receiving channels.

8 Claims, 9 Drawing Sheets

(56) References Cited

U.S. PATENT DOCUMENTS 5,470,063 A * 11/1995 Fisher ..... A63B 53/02 473/251
5,509,660 A * 4/1996 Elmer ..... A63B 53/0466 473/330
5,924,938 A * 7/1999 Hines ..... A63B 53/02 473/307
6,039,659 A * 3/2000 Hamm ..... A63B 60/16 473/307
6,743,112 B2 * 6/2004 Nelson ..... A63B 53/0487 473/340
7,037,211 B1 * 5/2006 Kosovac ..... A63B 60/00 473/304
7,309,297 B1 * 12/2007 Solari ..... A63B 53/0475 473/409
7,341,527 B1 * 3/2008 Fisher ..... A63B 53/065 473/340
7,416,494 B2 * 8/2008 Edel ..... A63B 53/06 473/340
7,984,559 B2 * 7/2011 Burns ..... G01B 11/02 33/508
8,905,857 B1 * 12/2014 Eckhart ..... A63B 69/3685 473/307
9,061,187 B2 * 6/2015 Yount ..... A63B 53/065
9,079,077 B2 * 7/2015 Wolf ..... A63B 60/32
9,330,406 B2 * 5/2016 Soracco ..... B22F 3/11
9,446,291 B2 * 9/2016 Sanyal ..... A63B 60/12
9,861,868 B2 * 1/2018 Hadad ..... A63B 53/065
10,071,293 B2 * 9/2018 Green ..... A63B 60/42
10,166,445 B2 * 1/2019 Brandt ..... A63B 53/02
11,141,636 B1 * 10/2021 Dixon ..... A63B 53/0416
2003/0232661 A1 * 12/2003 Greer, Jr. ..... A63B 53/0487 473/340
2005/0159235 A1 * 7/2005 Gray ..... A63B 53/02 473/340
2005/0227780 A1 * 10/2005 Cover ..... A63B 60/02 473/334
2008/0146372 A1 * 6/2008 John ..... A63B 53/007 473/341
2009/0233728 A1 * 9/2009 Liou ..... A63B 53/02 473/307
2012/0088599 A1 * 4/2012 Narita ..... A63B 53/0487 473/340
2015/0045137 A1 * 2/2015 Esposito ..... A63B 53/04 473/307
2020/0054923 A1 * 2/2020 Lee ..... A63B 53/065
2020/0179770 A1 * 6/2020 Lapuz ..... A63B 53/065

* cited by examiner

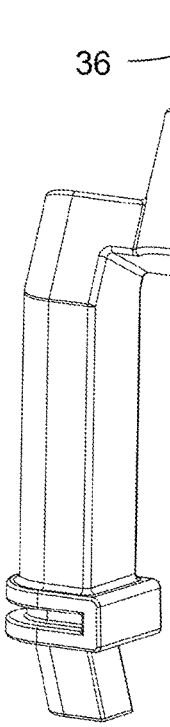
FIG. 1
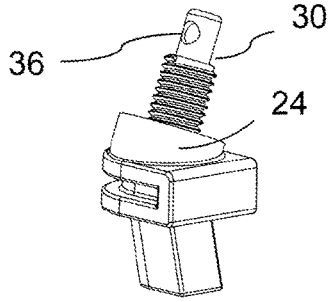
FIG. 2
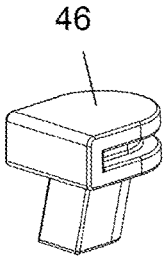
FIG. 3
FIG. 4
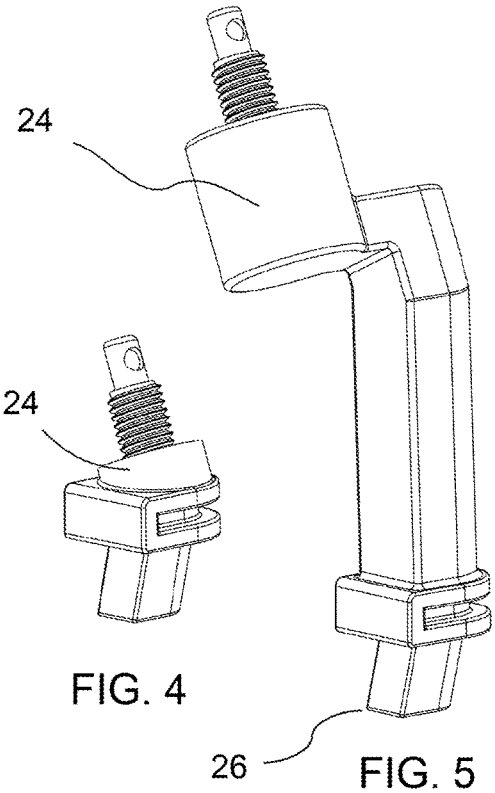
FIG. 5
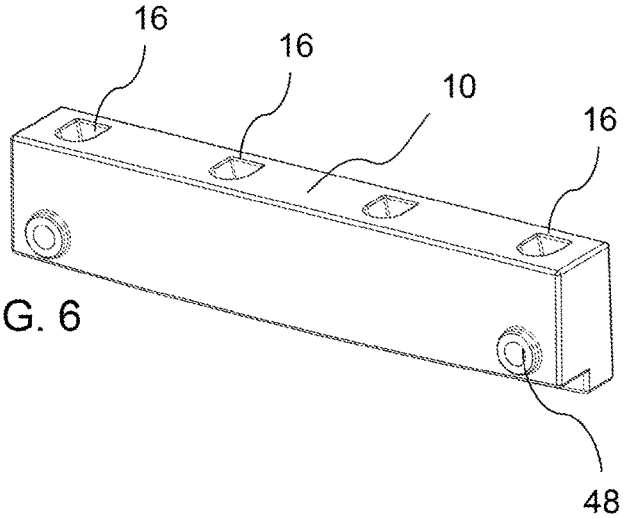
FIG. 6
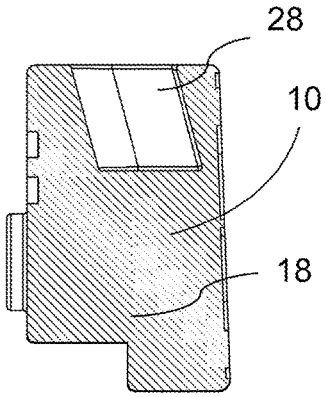
FIG. 7

CUSTOMIZED GOLF PUTTERS AND METHODS OF CONSTRUCTING CUSTOMIZED GOLF PUTTERS

CROSS-REFERENCE TO RELATED APPLICATIONS

This application is a continuation of U.S. patent application Ser. No. 16/875,883, filed on May 15, 2020, which claims priority to, and incorporates by reference, U.S. provisional patent application Ser. No. 62/901,555, filed on Sep. 17, 2019.

FIELD OF THE INVENTION

The field of the present invention relates to golf clubs and, more particularly, to customized golf putters and methods of configuring and assembling customized golf putters.

BACKGROUND OF THE INVENTION

For many years, golfers have benefited from the ability to customize particular features of golf clubs. Indeed, so-called custom golf fitting has been mainstream for some time, which has allowed golfers to tailor club head loft angles, shaft length, shaft stiffness, and other features to their particular swing attributes. In addition, the ability to reversibly move weighting elements from one area of a club head to another (e.g., in a driver or fairway wood) has enabled golfers to utilize such technology to create (or counteract) certain weight biases and ball flight patterns, such as fades, draws, and the like.

Although the ability to incorporate such customized features into golf club heads has been commercially-available for many years, such features have not been as prevalent in golf putters, particularly those which enable substantial adjustments in a golf putter. For example, switching from a blade-styled putter to a mallet-styled putter has, historically, required that golfers purchase an entirely new putter (accompanied by a new shaft, hosel, grip, etc.). Indeed, the customizable features that have been developed for golf putters have not enabled complete putter head interchangeability, nor have such features enabled golfers to select (and make changes to) hosel locations. Accordingly, there is a continuing demand for improved golf club putters—particularly golf club putters that enable golfers to incorporate a wider range of customized features.

As the following will demonstrate, the customized golf putters and methods of assembly thereof, as described herein, address such demands (and others) in the marketplace.

SUMMARY OF THE INVENTION

According to certain aspects of the present invention, customizable golf putters are provided. The golf putters include a putter face, which optionally includes an integrated face insert material disposed therein. The golf putters further include a putter head that is configured to be reversibly connected to the putter face, with the putter head also being selected by the golfer from a plurality of different putter head styles (e.g., blade-styled putter heads, mallet-styled putter heads, and/or others).

The invention provides that the putter face includes a first set of apertures located on a top surface of the putter face and an interior cavity that, in some embodiments, is configured to receive the optional face insert material. The invention further provides that the putter head includes a second set of apertures located on a top surface of the putter head, along with its own interior cavity that is configured to receive the putter face. According to such aspects of the invention, the first set of apertures of the putter face are contiguous with the second set of apertures of the putter head to form a plurality of hosel receiving channels when the putter face is inserted into the interior cavity of the putter head.

According to such aspects of the invention, the golf putters further include a hosel that is configured to be reversibly connected to any of the plurality of hosel receiving channels that are accessible on the top surface of the putter head. The invention provides that the hosel is selected by the golfer from a plurality of different hosel styles. Non-limiting examples of such hosel styles include hosels that exhibit different lengths, different lie angles, right-handed orientations, left-handed orientations, or combinations of the foregoing. According to certain preferred embodiments of the invention, the hosel includes a bottom area that is configured to be nestably inserted into and reversibly connected to a desired hosel receiving channel.

The hosel further includes a top post that is threaded (or partially threaded) and configured to be reversibly attached to a correspondingly threaded bottom aperture of a threaded shaft connector. The threaded shaft connector further includes a top threaded aperture located on a top surface thereof that is configured to receive and to be reversibly connected to a correspondingly threaded area of the putter shaft. According to such aspects of the invention, the golf putters further include one or more peg fillers, each of which are configured to be inserted into an empty hosel receiving channel that is not connected to (i.e., occupied by) the hosel. The invention provides that the one or more peg fillers are preferably selected by a golfer from a plurality of optional peg fillers having different weights (so that the golfer can easily adjust and tune the amount and placement of additional putter head weight).

According to additional aspects of the invention, methods for constructing a customized golf putter are provided. Such methods generally include the steps of selecting a putter head from a plurality of different putter head styles and selecting a hosel from a plurality of different hosel styles. Following such selections, the customized golf putter is assembled by inserting the selected putter face into a corresponding cavity located in the selected putter head; connecting the hosel to any of a plurality of hosel receiving channels that are accessible on a top surface of the putter head; connecting and securing the putter head to the putter face; and connecting a threaded shaft connector (which is connected to the putter shaft) to a top post of the hosel. In addition, the invention provides that such methods may further include selecting one or more peg fillers from a plurality of optional peg fillers having different weights—and then inserting the one or more peg fillers into empty hosel receiving channels that are not connected to the hosel.

The above-mentioned and additional features of the present invention are further illustrated in the Detailed Description contained herein.

BRIEF DESCRIPTION OF THE FIGURES

FIG. 1 is an illustration of a right hosel that may be used in the putters described herein.

FIG. 2 is an illustration of a right center shaft hosel that may be used in the putters described herein.

FIG. 3 is an illustration of a filler peg that may be used in the putters described herein.

FIG. 4 is an illustration of a left center shaft hosel that may be used in the putters described herein.

FIG. 5 is an illustration of a left hosel that may be used in the putters described herein.

FIG. 6 is an illustration of a putter face that may be used in the putters described herein.

FIG. 7 is a left cross-sectional view of the putter face of FIG. 6.

DETAILED DESCRIPTION OF THE INVENTION

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

Referring now to FIGS. 1-27, according to certain preferred embodiments of the present invention, customizable golf putters are provided. The golf putters include a putter face 10, which optionally includes an integrated face insert material disposed therein. The optional face insert material may be selected from a plurality of different face insert material options. Such face insert materials will be selected based on various desirable characteristics associated with the materials that comprise the face insert materials, such as acoustic (sound) characteristics, vibration damping characteristics, feel characteristics, weight, and other characteristics of the applicable materials. Non-limiting examples of different materials that can be used to construct the face insert material include plastics, elastomers, rubber, synthetic polymers, steel, alloys, combinations of the foregoing, and/or other suitable materials.

Figure 8:
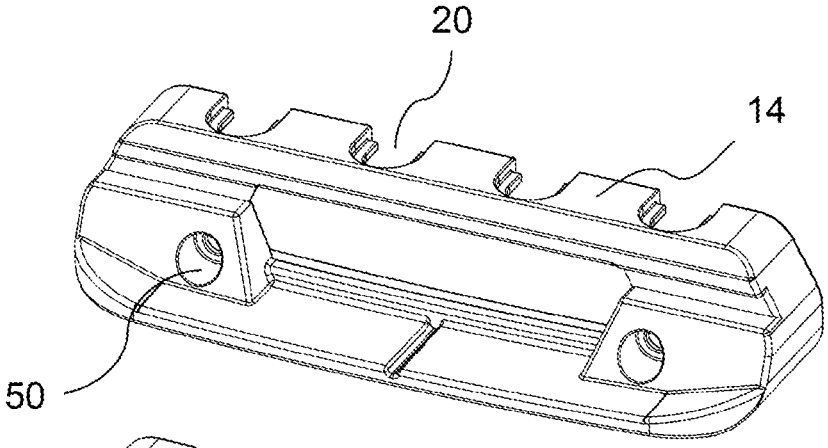
FIG. 8 is an illustration of a blade putter head that may be used in the putters described herein.
Figure 9:
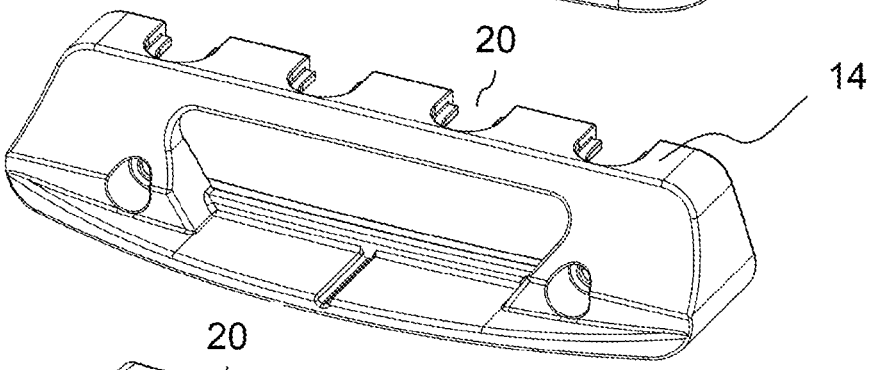
FIG. 9 is an illustration of another blade putter head that may be used in the putters described herein.
Figure 10:
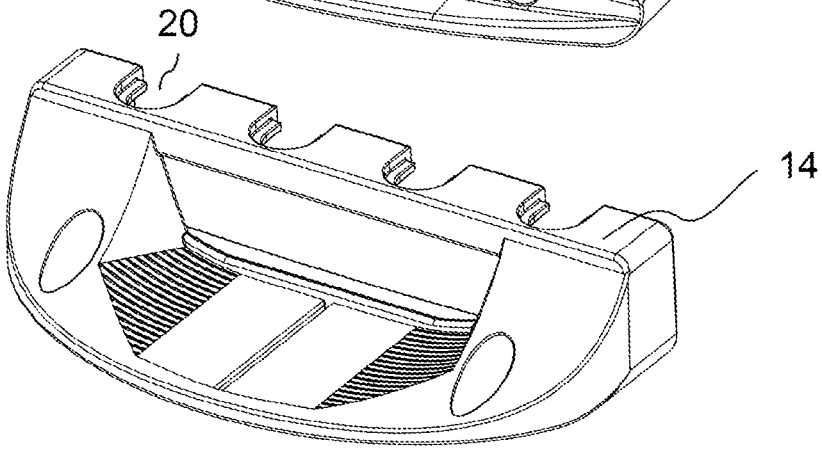
FIG. 10 is an illustration of a mallet putter head that may be used in the putters described herein.
Figure 11:
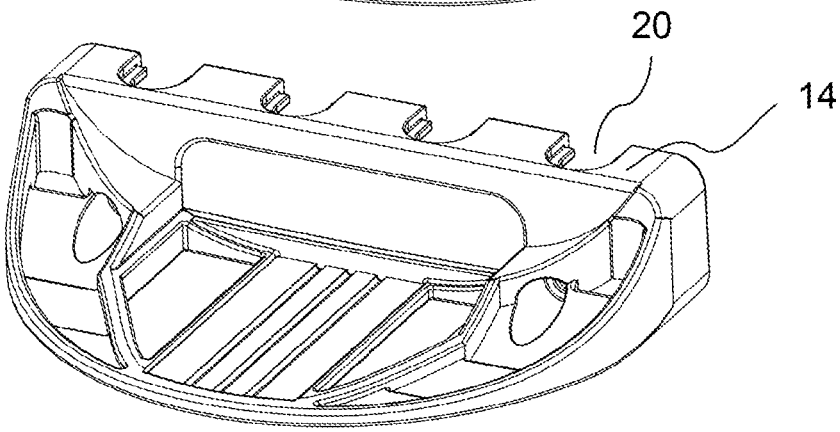
FIG. 11 is an illustration of another mallet putter head that may be used in the putters described herein.

The golf putters further include a putter head 14 that is configured to be reversibly connected to the putter face 10, with the putter head 14 being selected by the golfer from a plurality of different putter head styles. For example, the putter head 14 may exhibit the size, shape, and design of a blade-style putter head 14, as shown in FIGS. 8 and 9. Still further, the putter head 14 may exhibit the size, shape, and design of a mallet-style putter head 14, as shown in FIGS. 10 and 11.

According to such preferred embodiments, the invention provides that the putter face 10 includes a first set of apertures 16 (e.g., at least 2, 3, 4, 5, or more apertures 16) located on a top surface of the putter face 10 and, optionally, an interior cavity 18 that is configured to receive an optional integrated face insert material (FIG. 7). If utilized in the golf putter, the invention provides that the face insert material is configured and dimensioned to be integrated within the interior cavity 18 of the putter face 10. The invention further provides that the putter head 14 includes a second set of apertures 20 (e.g., at least 2, 3, 4, 5, or more apertures 20) located on a top surface of the putter head 14, along with its own interior cavity 22 that is configured to receive the putter face 10. According to such aspects of the invention, the first set of apertures 16 of the putter face 10 are contiguous with the second set of apertures 20 of the putter head 14 to form a plurality of hosel receiving channels 28 when the putter face 10 is inserted into the interior cavity 22 of the putter head 14. More specifically, the invention provides that the first set of apertures 16 of the putter face 10 are positioned such that the first set of apertures 16 of the putter face 10 will align with the second set of apertures 20 of the putter head 14, when the putter face 10 is inserted into the interior cavity 22 of the putter head 14.

According to such aspects of the present invention, the golf putters further include a hosel 24 that is configured to be reversibly connected to any of the plurality of hosel receiving channels 28 that are accessible on the top surface of the putter head 14 (as mentioned above, the plurality of hosel receiving channels 28 are formed by the combination of and adjacently located first set of apertures 16 located on a top surface of the putter face 10 and the second set of apertures 20 located on a top surface of the putter head 14). The invention provides that the hosel 24 is preferably selected by the golfer from a plurality of different hosel styles. Non-limiting examples of such hosel styles include hosels that exhibit different lengths, different lie angles, right-handed orientations, left-handed orientations, or combinations of the foregoing. For example, the hosel 24 illustrated in FIG. 1 accommodates right-handed golfers, whereas the hosel 24 illustrated in FIG. 5 accommodates left-handed golfers (while both exhibit a length of 1-3 inches and both are configured to preferably be positioned closer to the heel area of a putter head 14). Still further, for example, the hosel 24 illustrated in FIG. 2 accommodates right-handed golfers, whereas the hosel 24 illustrated in FIG. 4 accommodates left-handed golfers (while both exhibit a length of less than a single inch and both are configured to preferably be positioned closer to the center of a putter head 14, compared to the preferred location for the hosels 24 of FIGS. 1 and 5).

According to certain preferred embodiments of the invention, the hosel 24 includes a bottom area 26 that is configured to be nestably inserted into and reversibly connected to a desired hosel receiving channel 28. In the embodiments illustrated herein, the bottom area 26 of the hosel 24 exhibits three perpendicular sides (having a cross-sectional shape of a partial rectangle), with a fourth side that exhibits a curved dimension. As shown herein, the hosel receiving channels 28 exhibit a perimeter that matches the perimeter of the bottom area 26 of the hosel 24. This way, the bottom area 26 of the hosel 24 may be inserted into and nestably connected to the hosel receiving channels 28 in only a single and proper orientation. The invention provides, however, that the bottom area 26 of the hosel 24 and dimension of the hosel receiving channels 28 may exhibit other matching shapes and sizes, but will each preferably exhibit shapes and sizes that allow the bottom area 26 of the hosel 24 to securely and nestably mate with the hosel receiving channels 28 in only a single and proper orientation.

The invention provides that the bottom area 26 of the hosel 24 may be further secured and connected to the desired hosel receiving channel 28 through cements, magnets, snaps, and/or other attachment means. Importantly, the type of hosel 24 selected by the golfer will influence the desired hosel receiving channel 28 used to attach the hosel 24 to the putter face 10. For example, a right-handed hosel 24 (FIG. 1 or 2) will have the golfer selecting a hosel receiving channel 28 located on one side of the putter, whereas a left-handed hosel 24 (FIG. 4 or 5) will have the golfer selecting a hosel receiving channel 28 located on the other side of the putter. Similarly, golfers may have personal preferences with how close (or distant) from the heel of the putter head 14 the hosel 24 should be connected. Importantly, the putter face 10 and the putter head 14 are preferably symmetrical, such that the assembly will be configured to accommodate both right- and left-handed golfers (and both right- and left-handed hosels 24).

Figure 12:
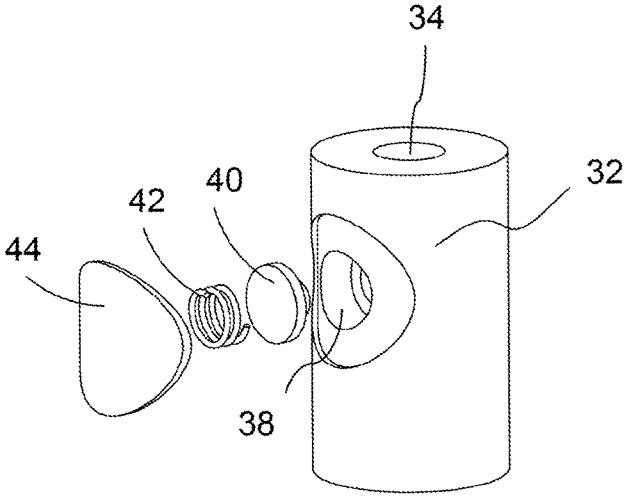
FIG. 12 is an illustration of a threaded shaft connector that may be used in the putters described herein.
Figure 13:
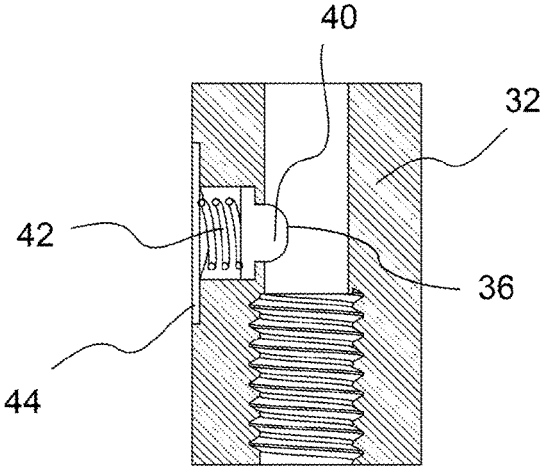
FIG. 13 is a side cross-sectional view of the threaded shaft connector of FIG. 12.
Figure 14:
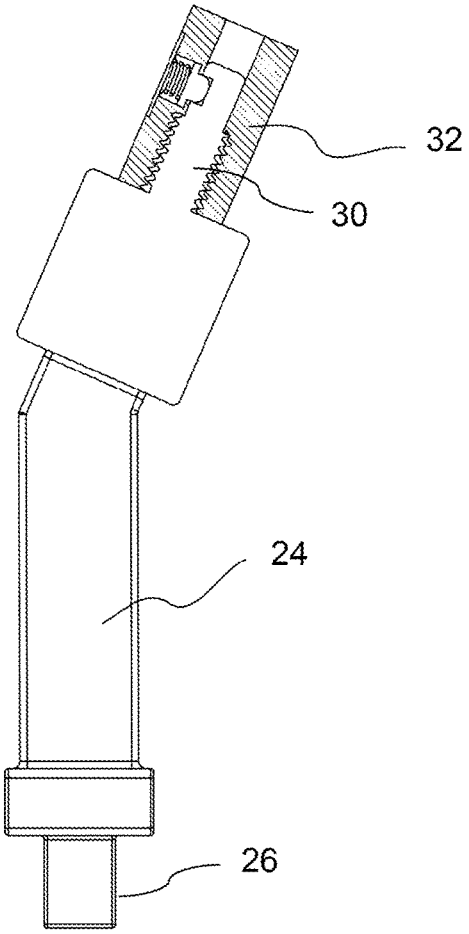
FIG. 14 is a side cross-sectional view of the right hosel of FIG. 1.
Figure 15:
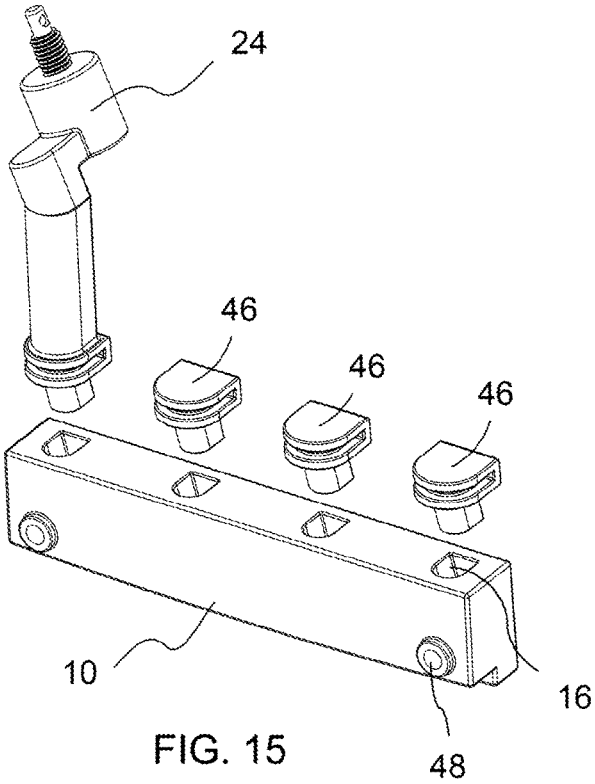
FIG. 15 is a back disassembled view of a putter face described herein.
Figure 16:
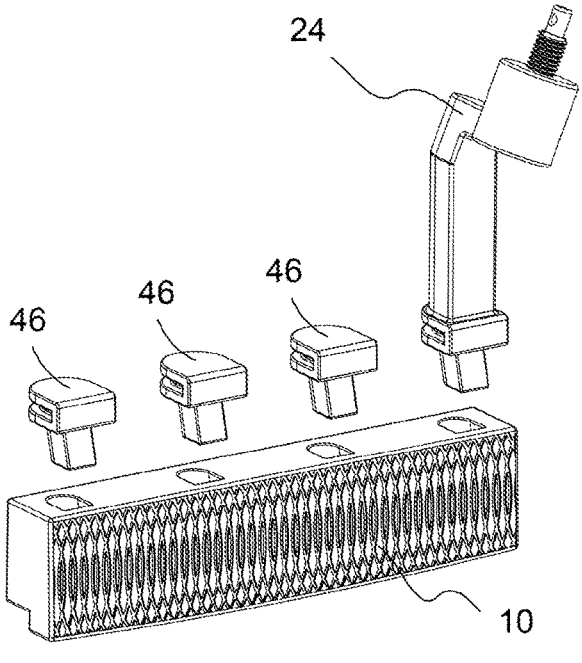
FIG. 16 is a front disassembled view of a putter face described herein.
Figure 17:
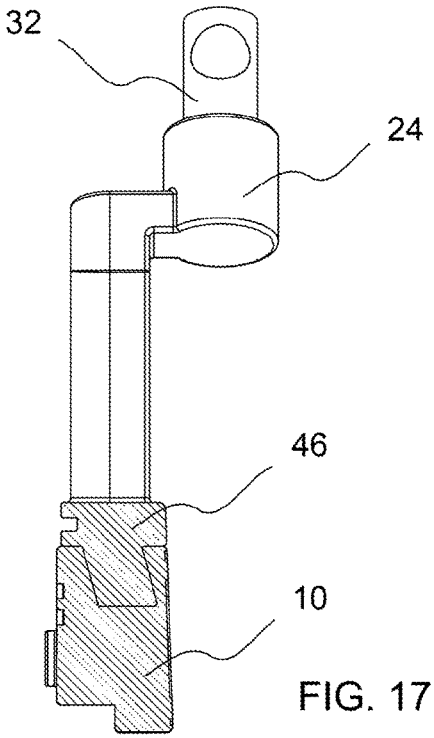
FIG. 17 is a front and partially cross-sectional view of a hosel connected to a threaded shaft connector and the putter face described herein.

The hosel 24 further includes a top post 30 that is threaded (or partially threaded) and configured to be reversibly attached to a correspondingly threaded bottom aperture of a threaded shaft connector 32 (FIG. 12). The threaded shaft connector 32 further includes a top threaded aperture 34 located on a top surface thereof that is configured to receive and to be reversibly connected to a correspondingly threaded area of the putter shaft 60 (in certain embodiments, the threaded shaft connector 32 will be provided to golfers in a preassembled format, with the threaded shaft connector 32 already connected to a putter shaft 60). In certain preferred embodiments, the top post 30 of the hosel 24 includes a locking cavity 36 (which consists of an indentation, cavity, or other recessed area)(FIG. 13). The invention provides that the threaded shaft connector 32 includes a side aperture 38 located on a side surface of the threaded shaft connector 32 that is configured to be located adjacent to the locking cavity 36 of the top post 30 of the hosel 24 when the threaded shaft connector 32 is connected to the hosel 24. According to such embodiments, the side aperture 38 of the threaded shaft connector 32 and the locking cavity 36 of the top post 30 of the hosel 14 are configured to reversibly receive a connecting pin 40. In such embodiments, the threaded shaft connector 32 further includes a small spring 42 that rests adjacent to the connecting pin 40—and a cap 44 that is configured to be reversibly connected to the side surface of the threaded shaft connector 32 and to enclose the small spring 42 and connecting pin 40 (see FIGS. 12-14).

Figure 18:
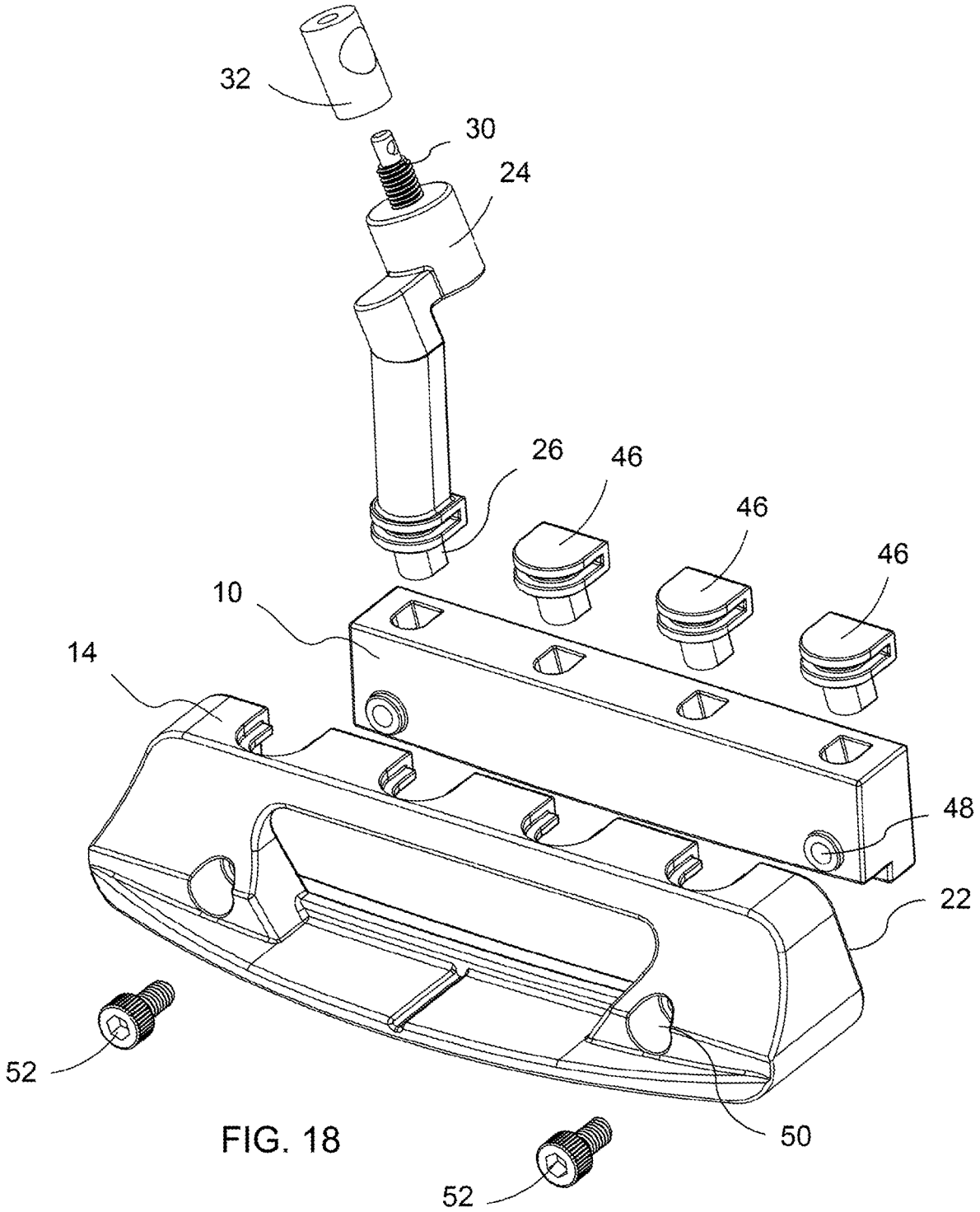
FIG. 18 is a back disassembled view of a putter described herein.
Figure 19:
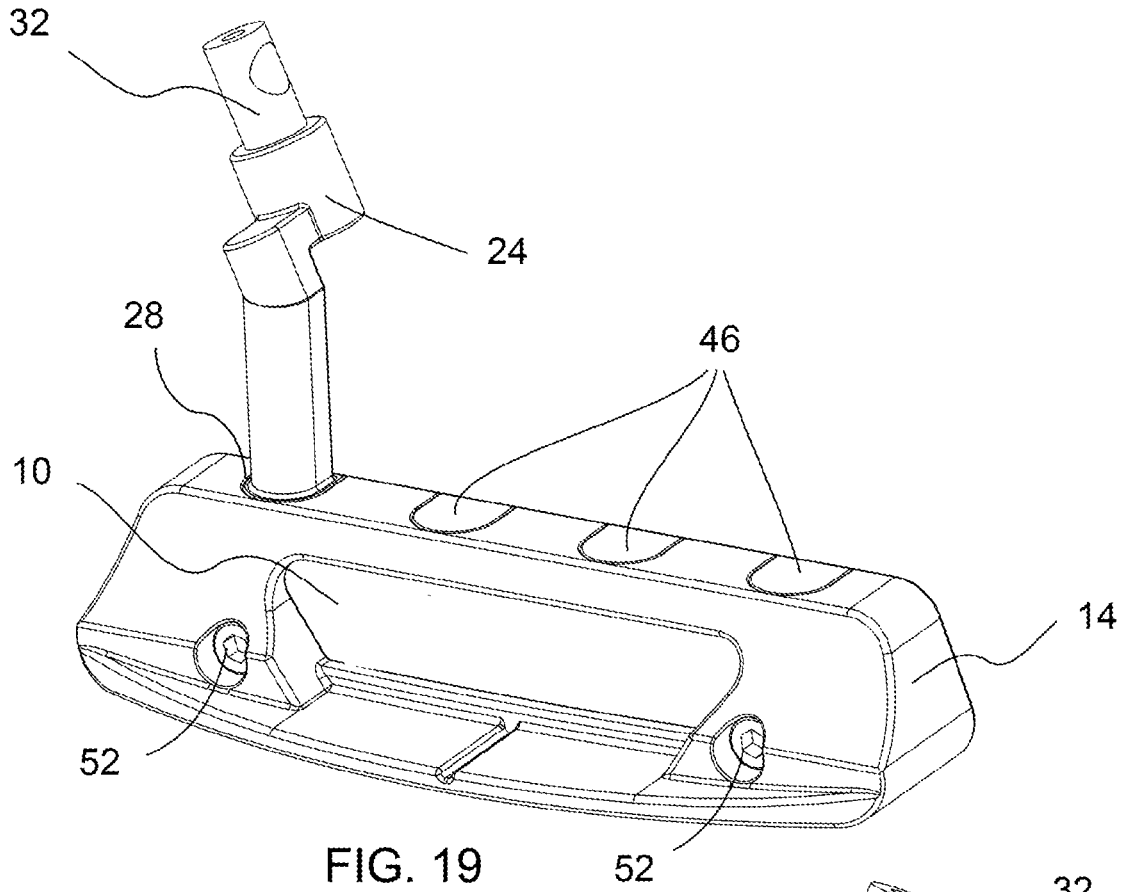
FIG. 19 is a back assembled view of a putter described herein.
Figure 20:
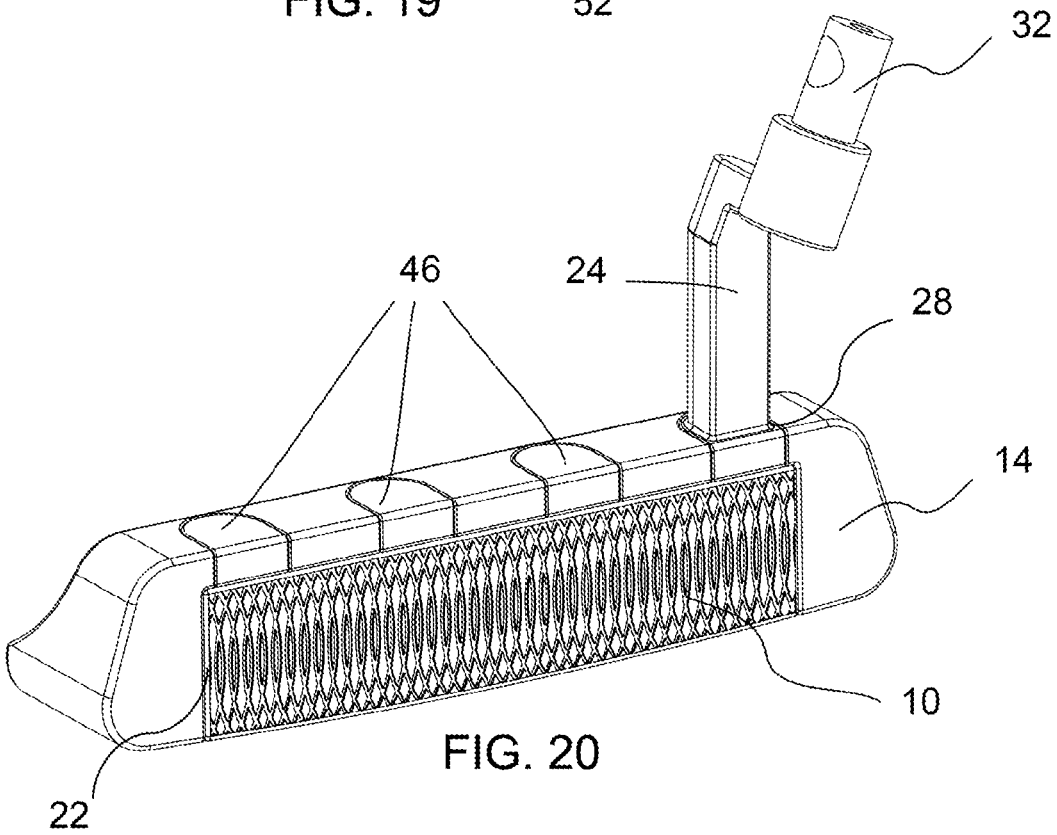
FIG. 20 is a front assembled view of a putter described herein.
Figure 21:
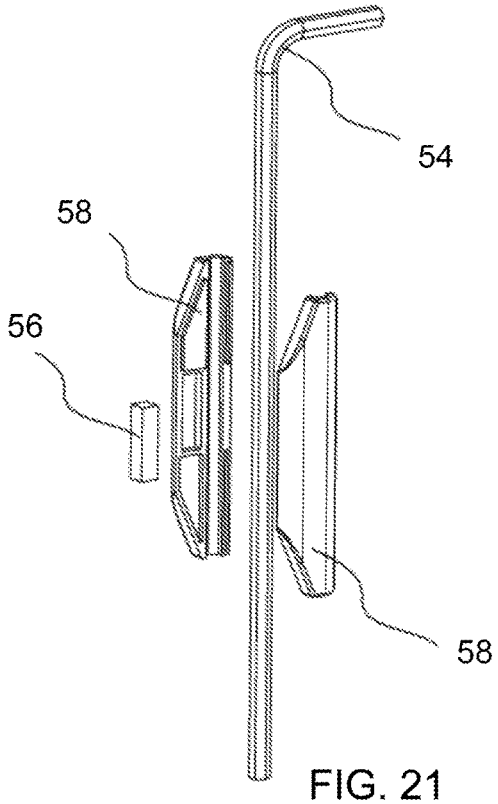
FIG. 21 is a disassembled view of a magnetic hex key (Allen wrench) used in the putter assemblies described herein.
Figure 22:
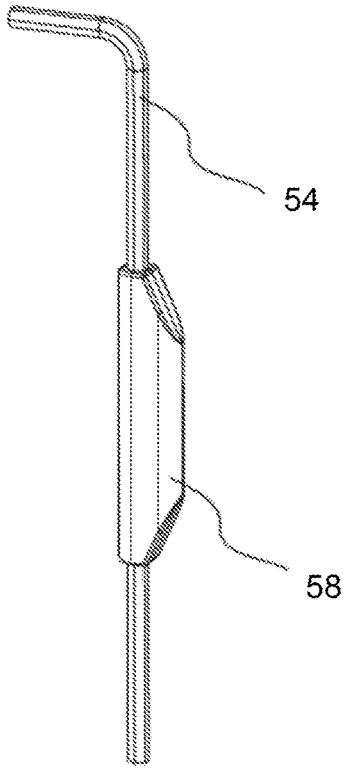
FIG. 22 is an assembled view of the magnetic hex key (Allen wrench) of FIG. 21.
Figure 23:
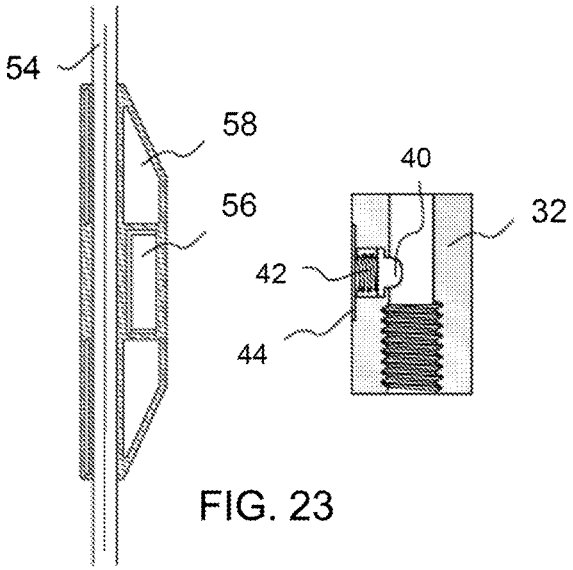
FIG. 23 is a side cross-sectional view of the magnetic hex key (Allen wrench) of FIG. 21 and a side cross-sectional view of a threaded shaft connector described herein.

According to certain preferred embodiments of the present invention, the golf putters further include one or more peg fillers 46, each of which are configured to be nestably inserted into an empty hosel receiving channel 28 that is not connected to (i.e., occupied by) the hosel 24 (FIG. 18). The invention provides that the one or more peg fillers 46 are preferably selected by a golfer from a plurality of optional peg fillers having different weights (so that the golfer can easily adjust and tune the amount and placement of additional putter head weight). The invention provides that the optional peg fillers 46 having different weights may comprise plastics, elastomers, rubber, synthetic polymers, steel, alloys, other metals, combinations of the foregoing, and/or other suitable materials, such that the peg fillers 46 exhibit different weights from which a golfer may select for incorporation in the golf putter. In certain preferred embodiments, the invention further provides that each of the one or more peg fillers 46 has a top surface that is preferably configured to rest in a coplanar orientation with the top surface of the putter head 14 when the one or more peg fillers 46 are inserted into the plurality of unoccupied hosel receiving channels 28 (see FIGS. 19-20). The one or more peg fillers 46 may be reversibly attached to and held in place within the unoccupied hosel receiving channels 28 through gravitational force, rubber or elastomeric rings, magnetic force, snaps, cements and/or other mechanical attachment means.

The invention provides that the putter face 10 and putter head 14 may be reversibly connected to each other through a variety of means, including snaps, magnets, or other mechanical attachment means. In certain preferred embodiments, the invention provides that the back side of the putter face 10 and a back side of the putter head 14 each include one or more threaded apertures 48/50. The invention provides that the one or more threaded apertures 48 located on the back side of the putter face 10 (FIG. 6) are contiguous with the one or more apertures 50 located on the back side of the putter head 14 (FIG. 8) to form one or more contiguous threaded connecting channels, when the putter face 10 is inserted into the interior cavity 22 of the putter head 14. According to such embodiments, the one or more contiguous threaded connecting channels are configured to receive one or more screws 52—such as two screws 52 located near the heel and toe areas of the putter head 14 (FIG. 18)— to reversibly connect the putter face 10 and putter head 14 to each other.

Figure 24:
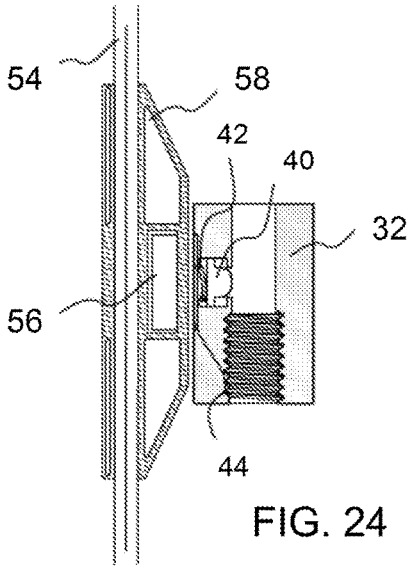
FIG. 24 is a side cross-sectional view of the magnetic hex key (Allen wrench) of FIG. 21 immediately adjacent to a side cross-sectional view of a threaded shaft connector described herein.
Figure 25:
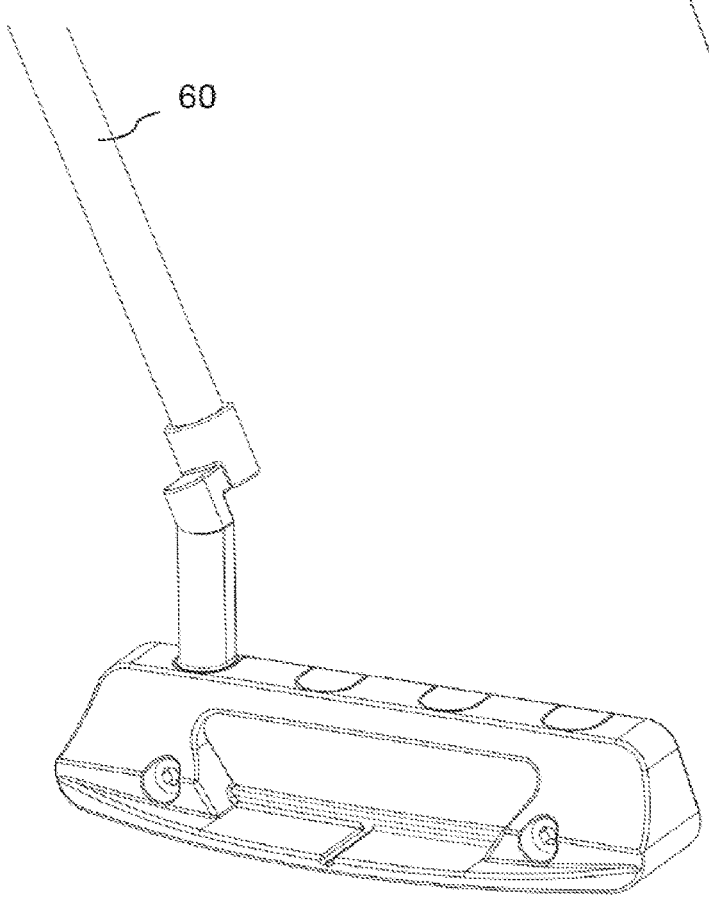
FIG. 25 is a fully assembled view of a golf putter of the present invention, including a shaft connected thereto.
Figure 26:
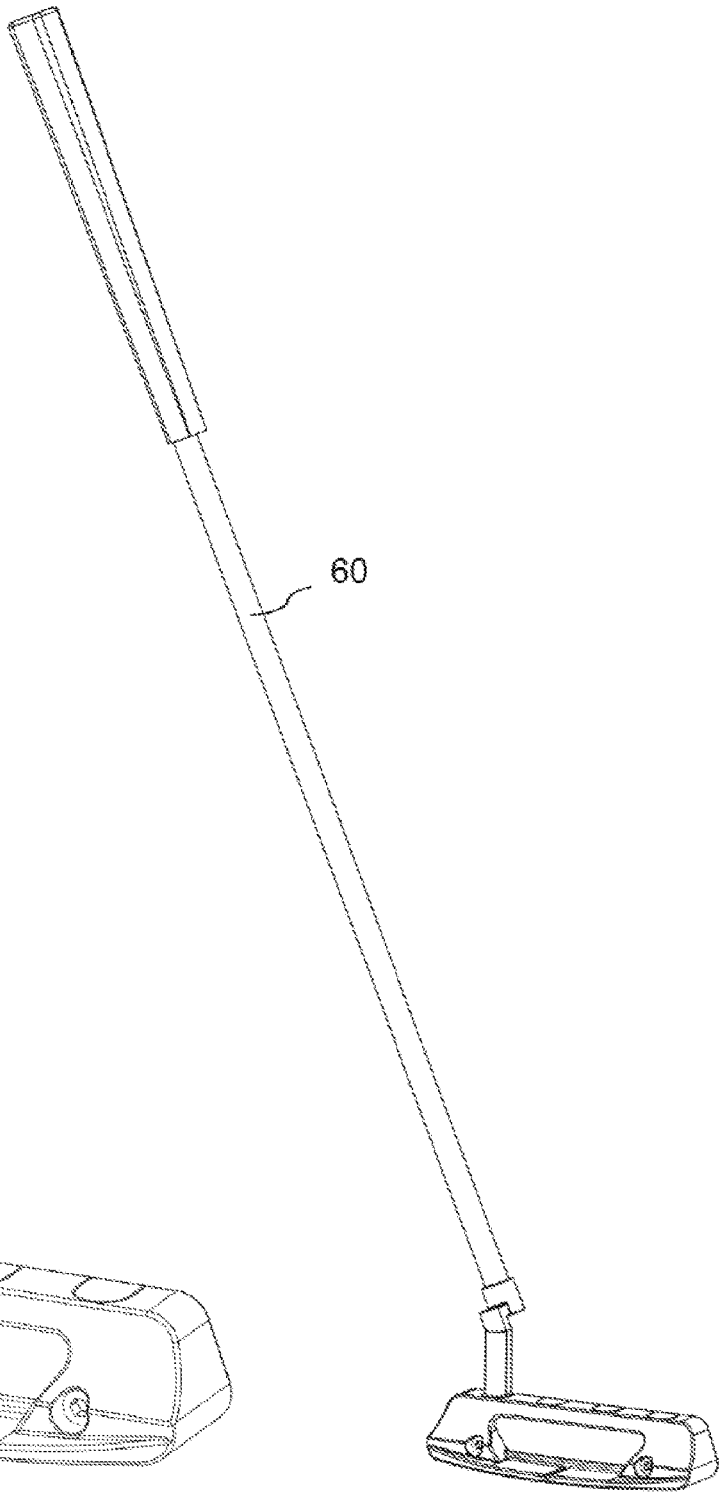
FIG. 26 is another fully assembled view of a golf putter of the present invention, including a shaft connected thereto.

The invention provides that the golf putters of the present invention may further include (and be sold with) a separate hex key tool 54 (Allen wrench), which includes a magnet 56 that can be used to remove the metallic cap 44, small spring 42, and connecting pin 40 from the threaded shaft connector 32 (FIGS. 21-24). In such embodiments, the magnet 56 may be held and encapsulated within a dedicated casing 58 that is affixed to and surrounds the hex key tool 54. The invention provides that the hex key tool 54 will include one or two ends that can be used to loosen and tighten (as desired) the one or more screws 52 used to connect the putter face 10 and putter head 14 to each other. In addition, as illustrated in FIG. 24, the casing 58 that holds the internal magnet 56 can be placed immediately adjacent to the metallic cap 44 to facilitate its removal (along with the removal of the small spring 42 and connecting pin 40) from the threaded shaft connector 32.

Importantly, the invention provides that the various components of the putters described herein are interchangeable and may be replaced by golfers as desired. For example, if a golfer wishes to replace a first style of putter head 14 with a second style of putter head 14, the golf putter may be disassembled (to remove the first style of putter head 14) and then reassembled with the second style of putter head 14. Similarly, if a golfer wishes to replace a first style of a hosel 24 with a second style of a hosel 24, the golf putter may be disassembled (to remove the first style of a hosel 24) and then reassembled with the second style of a hosel 24.

The invention further provides that certain components of the putters described herein—such as the putter head 14, hosel 24, and other metallic components described herein—may be produced from stainless steel (or other suitable materials). For example, stainless steel blocks may be cut into the desired shape and configuration using computer numerical control (CNC) milling machines to produce the desired parts (or, alternatively, such parts may be manufactured from casted metal and/or CNC milled aluminum).

Figure 27:
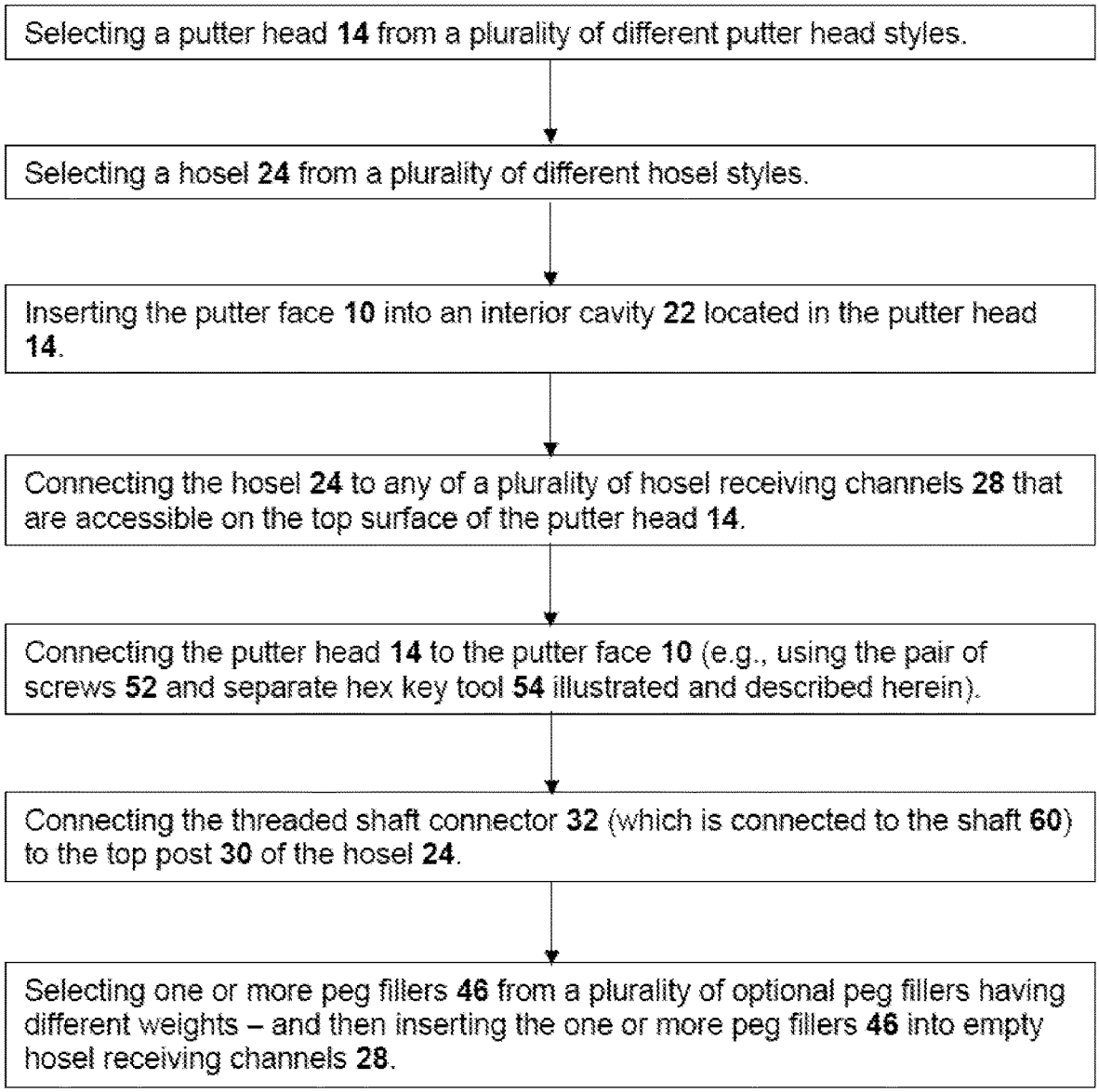
FIG. 27 is a flow diagram that summarizes certain methods of the present invention, namely, methods for customizing and constructing the golf putters described herein.

Referring now to FIG. 27, according to additional preferred embodiments of the present invention, methods for constructing the customized golf putters described herein are provided. Such methods generally include the steps of selecting a putter head 14 from a plurality of different putter head styles (e.g., FIGS. 8-11) and selecting a hosel 24 from a plurality of different hosel styles (e.g., FIGS. 1, 2, 4, and 5). Such component selections may be carried out by golfers in-person (within a conventional retail store environment) or, in other embodiments, within and using an on-line/e-commerce platform.

Following such selections, the customized golf putter is assembled by inserting the putter face 10 into an interior cavity 22 located in the selected putter head 14; connecting the selected hosel 24 to any of a plurality of hosel receiving channels 28 that are accessible on the top surface of the putter head 14; connecting the putter head 14 to the putter face 10 (e.g., using the pair of screws 52 and separate hex key tool 54 illustrated and described herein); and connecting the threaded shaft connector 32 to the top post 30 of the hosel 24 (the threaded shaft connector 32 will preferably be preassembled and connected to a putter shaft 60). In addition, the invention provides that such methods may further include selecting one or more peg fillers 46 from a plurality of optional peg fillers having different weights—and then inserting the one or more peg fillers 46 into empty hosel receiving channels 28 (i.e., hosel receiving channels 28 that are not otherwise connected to the hosel 14). The invention provides that the selection steps described above may be carried out any desired order. Likewise, the invention provides that the assembly steps described above may also be carried out any desired order.

The many aspects and benefits of the invention are apparent from the detailed description, and thus, it is intended for the following claims to cover all such aspects and benefits of the invention that fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A customizable golf putter, which comprises:
(a) a putter face;
(b) a putter head;
(c) a hosel that is configured to be reversibly connected to any of a plurality of hosel receiving channels that are accessible on a top surface of the putter head; and
(d) a threaded shaft connector that is connected to the hosel and to a putter shaft, wherein:
(i) the putter face includes a first set of apertures located on a top surface of the putter face;
(ii) the putter head includes a second set of apertures located on the top surface of the putter head and an interior cavity that is configured to receive the putter face, wherein the first set of apertures of the putter face are contiguous with the second set of apertures of the putter head to form the plurality of hosel receiving channels when the putter face is inserted into the interior cavity of the putter head;
(iii) the hosel includes a bottom area that is configured to be nestably inserted into and reversibly connected to any of the hosel receiving channels; and
(iv) one or more peg fillers, each of which are configured to be inserted into an empty one of the hosel receiving channels that is not connected to the hosel.

2. The customizable golf putter of claim 1, wherein:
(a) the hosel is selected by a golfer from a plurality of different hosels that exhibit different lengths, different lie angles, right-handed orientations, left-handed orientations, or combinations of the foregoing; and
(b) the putter head is selected by the golfer from a plurality of different putter heads that include blade putter heads and mallet putter heads.

3. The customizable golf putter of claim 1, wherein:
(a) a back side of the putter face and a back side of the putter head each include one or more threaded apertures;
(b) the one or more threaded apertures located on the back side of the putter face are contiguous with the one or more apertures located on the back side of the putter head to form one or more contiguous threaded connecting channels, when the putter face is inserted into the interior cavity of the putter head; and
(c) the one or more contiguous threaded connecting channels are configured to receive one or more screws to reversibly connect the putter face and putter head to each other.

4. The customizable golf putter of claim 1, wherein:
(a) a top post of the hosel includes a locking cavity;
(b) the threaded shaft connector includes a side aperture located on a side surface of the threaded shaft connector that is configured to be located adjacent to the locking cavity of the top post of the hosel when the threaded shaft connector is connected to the hosel; and
(c) the side aperture of the threaded shaft connector and the locking cavity of the top post of the hosel are configured to reversibly receive a connecting pin.

5. The customizable golf putter of claim 4, which further comprises:
(a) a spring that rests adjacent to the connecting pin; and
(b) a cap that is configured to be reversibly connected to the side surface of the threaded shaft connector and to enclose the spring and connecting pin.

6. The customizable golf putter of claim 5, which further comprises a separate hex key tool, which includes a magnetic area that can be used to remove the cap, the spring, and the connecting pin from the threaded shaft connector.

7. The customizable golf putter of claim 1, wherein the one or more peg fillers are selected by a golfer from a plurality of optional peg fillers having different weights.

8. The customizable golf putter of claim 7, wherein each of the one or more peg fillers have a top surface that is configured to rest in a coplanar orientation with the top surface of the putter head when the one or more peg fillers are inserted into the plurality of hosel receiving channels.

* * * * *